US007017493B2

(12) United States Patent
Jung et al.

(10) Patent No.: US 7,017,493 B2
(45) Date of Patent: Mar. 28, 2006

(54) METHOD FOR TREATING THE SURFACE OF A SUBSTRATE AND A DEVICE FOR CARRYING OUT SAID METHOD

(75) Inventors: Ulrich Jung, Limburg (DE); Thomas Walther, Freigericht (DE)

(73) Assignee: Man Roland Drickmaschinen AG, Offenbach/Main (DE)

( * ) Notice: Subject to any disclaimer, the term of this patent is extended or adjusted under 35 U.S.C. 154(b) by 0 days.

(21) Appl. No.: 10/276,619

(22) PCT Filed: May 4, 2001

(86) PCT No.: PCT/EP01/05047

§ 371 (c)(1),
(2), (4) Date: Mar. 21, 2003

(87) PCT Pub. No.: WO01/88268

PCT Pub. Date: Nov. 22, 2001

(65) Prior Publication Data

US 2003/0221571 A1 Dec. 4, 2003

(30) Foreign Application Priority Data

May 17, 2000 (DE) ..... 100 24 370

(51) Int. Cl.
*B41F 25/00* (2006.01)
*B41F 23/04* (2006.01)

(52) U.S. Cl. ..... 101/488; 101/487

(58) Field of Classification Search ..... 101/487, 101/488; 399/320, 328, 330, 331, 335, 336, 399/338; 427/361, 362; 100/38, 92, 176
See application file for complete search history.

(56) References Cited

U.S. PATENT DOCUMENTS 2,277,426 A 3/1942 Wolf et al.
2,554,663 A 5/1951 Cowgill (Continued)

FOREIGN PATENT DOCUMENTS

DE 41 05 952 A1 8/1992
DE 198 26 974 A1 12/1999
EP 0 637 467 A1 6/1994

(Continued)

*Primary Examiner*—Daniel J. Colilla
(74) *Attorney, Agent, or Firm*—Leydig, Voit & Mayer, Ltd.

(57) ABSTRACT

A method and apparatus for treating the surface of substrates such as printed sheets, with improved surface quality. The apparatus includes a first roller (2, 7) rotatable in a first direction and forming a placement surface for traveling printed sheets, one or more second rollers (4, 5, 6) mounted parallel to the first roller (2, 7) for defining a roller nip with the first roller through which the sheets are directed and for exerting a predetermined radial pressing force against the sheets, the second rollers (4, 5, 6) being rotatable in a direction opposite to the direction of rotation of the first roller (2, 7) and at least some of the second rollers (4, 5, 6) having a heating device for heating the printed sheet in the area of the roller nip between the first and second rollers.

18 Claims, 3 Drawing Sheets

U.S. PATENT DOCUMENTS

| | | | | | |
|---|---|---|---|---|---|
| 3,349,749 | A | * | 10/1967 | Utschig | 118/60 |
| 3,963,843 | A | | 6/1976 | Hitchmough et al. | |
| 4,481,876 | A | | 11/1984 | Amendola | |
| 4,732,084 | A | * | 3/1988 | Wirz | 101/177 |
| 5,835,834 | A | * | 11/1998 | Asada | 399/328 |
| 6,093,248 | A | | 7/2000 | Kohl et al. | |
| 6,308,021 | B1 | * | 10/2001 | Isogai et al. | 399/67 |

FOREIGN PATENT DOCUMENTS

| | | | | |
|---|---|---|---|---|
| EP | 0 791 687 | A1 | | 1/1997 |
| JP | 57182767 | A | * | 11/1982 |
| JP | 02032368 | A | * | 2/1990 |
| JP | 06149118 | A | * | 5/1994 |
| WO | WO 94/15718 | A2 | | 7/1994 |

* cited by examiner

METHOD FOR TREATING THE SURFACE OF A SUBSTRATE AND A DEVICE FOR CARRYING OUT SAID METHOD

FIELD OF THE INVENTION

The present invention relates generally to the treatment of substrates in printing processes and the like, and more particularly, to an apparatus and method for treating printed sheets in printing machines.

BACKGROUND OF THE INVENTION

In the printing and photographic industry, high-quality surfaces are produced by providing the corresponding substrate, for example, a paper sheet, with a lacquer layer at the end of the process. In lacquering systems, curing of the lacquer layer may be accelerated by irradiation with UV light so as to permit direct coupling of the lacquer unit to a printing machine. The application of lacquer layers and the ensuring of a sufficiently rapid curing of the layers, however, can cause problems, particularly during start up or a process interruption, since under certain circumstances, a substrate with an uncrosslinked lacquer from the lacquering unit must be removed and considerable emissions can thus appear. The emissions appearing in connection with the curing of the lacquers require costly precautions.

An advantage of such surface treatment with printing products lies in the glossy finish produced, depending on the lacquering system, in addition to increased abrasion resistance and improved protection against wear.

OBJECTS AND SUMMARY OF THE INVENTION

It is an object of the present invention to provide a method and apparatus for reliably obtaining a desired surface quality for substrates such as individually transported printed sheets being directed through a sheet feed and offset printing module.

Another object is to provide a method and apparatus as characterized above which can be readily implemented into modem printing machines.

In carrying out the invention, an apparatus for the surface treatment of printing sheets is provided that includes a first roller which can rotate in a first direction and which forms a placement surface on which the printed sheet lies along an essentially circumferential segment; a second roller, arranged axially parallel to the first roller, wherein the second roller acts on the printed sheet with a determined radial force and can rotate in a direction opposite to the first direction; and a heating device for the heating of the printed sheet that is in a roller nip formed by the first roller and the second roller.

In this way, it is advantageously possible to attain high-quality surfaces with printing processes in which printed sheets are transported in a curved manner. Moreover, it is advantageously possible to attain glossy or matte finish effects or also glossy/matte finish effects in combination by using a single lacquer system with a matching of the inherent surface features of the second roller. The desired surface can thereby be respectively produced with high accuracy.

In accordance with a particularly preferred embodiment of the invention, the apparatus is integrated directly into a sheet-fed offset printer. In this way, a particularly compact system structure is attained. For example, the first roller can be directly defined by a printing cylinder or a transfer drum, for example.

The second roller is advantageously made of a material whose rigidity is greater than that of the printed sheet material. In this way, a sufficient flattened pressing in the roller nip is achieved with comparatively low radial roller forces. The second roller (and advantageously also the first roller) is preferably formed, at least in the area of its outside surface, from a metal material.

The diameter of the first roller preferably is chosen in such a way that the outside circumference of the roller is greater than the length of the printed sheet or substrate, measured in the machine direction. In accordance with a particularly preferred embodiment, the diameter of the first roller is selected in such a way that its circumferential length corresponds to twice the maximum printed sheet length plus the circumferential length which is taken up by sheet gripping devices of the cylinder.

The diameter of the second roller preferably is smaller than the diameter of the first roller. Preferably, the circumferential length of the second roller corresponds to 1/n times the circumferential length of the first roller, where n is the number of printed sheet zones of the first roller.

In accordance with a particular feature of the invention, the heating device is preferably placed in such a way that it heats the outside surface of the second roller from the outside. In this way, it is advantageously possible to maintain the desired roller temperature within a small tolerance range.

One embodiment of the heating device which is advantageous from the standpoint of simplified maintenance comprises a radiant heat source. The radiated heat that preferably is radiated onto the outside surface of the second roller is in the infrared region of the spectrum. The intensity of the heat radiation can, for example, take place by control/regulation of the power consumption of the radiation source. Alternatively, or in combination with this measure, it is possible to adjust the heating of the second roller in a defined mannerby the distance of the radiation source from the roller or also by the placement of reflectors or shields.

As an alternative to externally heating the outside surface of the second roller, or again, in combination therewith, it is also possible to integrate the heating device into the second roller. The power can be supplied electrically via sliding contact arrangements or also in a contact-free manner, for example, inductively.

It is advantageously possible to produce the heat for the heating, using a roller core or a heating layer, wherein the roller core of the heating layer is made of an electrically conductive plastic, in particular, a temperature-resistant, conductive silicone rubber. Alternatively, electrical heating devices and heating devices using a heat carrier, Thermo oil, can be used.

In accordance with a particularly preferred embodiment of the invention, a desired surface effect can be produced on the substrate by reason of the outside surface of the second roller having a determined surface roughness. This defined surface roughness can advantageously be selectively established by blasting or etching methods. It also is possible to form the outside surface by means of an inserted plate or shell so that a desired machine configuration can be attained by selected exchange or use of the elements forming the outside surface of the roller.

In an embodiment of the invention which is particularly advantageous for processing of a relatively pliable printed sheets, along the circumferential direction of the first roller, which is axially parallel to the second roller, at least one other roller is provided. In this way, it is advantageously possible to subject the printed sheet, while on the first roller, to at least two roller treatments wherein, advantageously, the roller pressure in the first roller nip is less than in the second roller nip. Preferably, the temperature of the outside surface of the first roller is set higher than the temperature of the outside surface of the second roller.

In accordance with a preferred embodiment of the invention, an advantageous matching of the individual printing material and the lacquer or ink application can be attained in that the radial contact pressure of the roller or rollers adjacent to the first roller can be adjusted. With relatively wide rollers, they can preferably be designed with a convex to compensate for the bending of the rollers. It also is possible to undertake a prestressing of the bearings of the individual rollers.

The outside surface temperature of one of the rollers adjacent to the first roller can advantageously be adjusted by inclusion of a regulating device. The outside surface temperature of these rollers can be adapted to the instantaneous roller rotary speed, e.g., on the basis of a characteristic field. In this way, it is possible to ensure the required heat input, even with different passage rates of the printed sheet through the roller nip. The heat storage capacity of the second roller is preferably selected to be low enough that a sufficient dynamics range of the temperature regulation is ensured, and that even when the roller arrangement is at a standstill, an inadmissibly high local overheating cannot occur in the area of the roller nip.

It is possible to make the temperature of the rollers adjacent to the transfer drum uniform by supporting the rollers with appropriate support roller arrangements. These support roller arrangements preferably comprise rollers with an elastomer contact surface. The support rollers also can be designed in such a way that they can be heated.

As previously indicated, the first roller can be designed, for example, as a transfer drum. In this way, it is possible to effect a surface treatment in a sheet-fed printer between the inking or lacquering units according to the ink or lacquer application behaviors. Especially with this embodiment, there is significant design flexibility with regard to the arrangement and execution of the second, heated roller.

As an alternative to the first roller being a transfer drum, it is also possible for the first roller to be a printing cylinder of a lacquering or spreading module and for the second roller to be placed in the area where the sheet emerges. The second temperature-controllable roller and, if necessary, the other, also preferably temperature-controllable rollers, associated with the printing cylinder of the lacquering or spreading module, act as smoothing rollers.

In a particularly advantageous manner, it is also possible to place the second roller in the area where the sheet ascends. In this way, it is possible to allow the just smoothed printed sheet, heated in the area of the printing surface, to enter the printing, lacquering, or spreading unit.

In an advantageous manner, lacquering or spreading can be undertaken on successive, individual printed sheets in the printing, lacquering, or spreading unit, wherein it is possible to attain a homogeneous printed sheet surface, with a high-gloss effect, if necessary, with the sheet printing process.

The integrated surface treatment process made possible by the roller arrangement for sheet-fed printers in accordance with the invention has the advantage that no other lacquering system, for example, a UV lacquering system, need be used in addition to the usually used dispersion lacquers. In this way, the power requirement for the unit is kept at a low level. In addition, expensive (UV) dryer systems can be eliminated. Also, the emission and the disposal problems associated with the processing of UV lacquer systems are avoided or at least reduced.

In accordance with a particularly preferred embodiment of the invention, a lacquer, which is formed from, or at least contains, a thermoplastic, may be applied to the printed sheet and is melted into or onto the printed sheet in the roller nip at a temperature in the range of 80 to 150° C. Within the framework of a contact melting process, the desired gloss or matte finish can be adjusted via the surface roughness of the heated roller. The heated roller can be optionally wetted with a releasing agent, by which means excessive adhesion of the lacquer or the ink, which is applied beforehand to the printed sheet, can be avoided.

By heating the second roller, which rolls against the printed sheet, it is possible to achieve the desired surface effect at low roller pressures. In this way, the processing, for example, the printing of pliable printed sheets, particularly corrugated paper sheets, is made possible without their being overly compressed.

The rollers, which roll against the printed sheet that lies on the outside circumferential surface of the first roller, are supported in such a way that their availability to the printing material or sheet to be printed is adjustable. Preferably, the contact force of the several cylinders which function as smoothing rollers are independently adjustable. The corresponding adjustment drives can be preferably controlled by a motor via central control locations.

The surfaces of the smoothing rollers are preferably protected against corrosion and have a surface roughness in accordance with the required degree of smoothness. For high-gloss effects, the smoothing rollers preferably have polished or chromed surfaces.

The temperature of the surfaces of the smoothing rollers is preferably 120 to 150° C. in regular operation, where the temperature can be regulated so that it is adapted to the sheet transport rate.

In accordance with a particularly preferred embodiment of the invention, cooling rollers are provided, in addition to the temperature-controllable smoothing rollers. By means of the cooling rollers, the printing material or printed sheet again is cooled immediately after the smoothing process by direct contact with the printing material or printed sheet surface. Alternatively or in addition to this measure, it is also possible to effect cooling by blowing ambient air or cooled air onto the sheet.

In addition to high-boiling oils or electrical heating devices, the heating of the rollers can take place by means of strip heaters or heating mats with their own temperature stabilization or regulation. Here also in accordance with a preferred embodiment of the invention, a transfer of electrical energy to the roller takes place via rotating transfer units, for example, in the form of slip-rings. Particularly with the use of radiant heat sources for heating the smoothing rings, shielding devices are advantageously provided in order to prevent the radiation of heat to adjacent components. Especially when using the smoothing roller arrangement in accordance with the invention, in the vicinity of an intermediate dryer of a double lacquering unit, the extensive housing of the rollers also proves to be advantageous in regard to minimizing energy consumption.

In heating the smoothing rollers, using a radiant heat source, for example, an electric heating radiator, the roller core preferably is constructed in such a way that it has relatively low thermal conductivity. In accordance with a particularly preferred embodiment of the invention, this can be achieved by using a CFK or ceramic composite material for the core. The metal surface of the smoothing roller, which is preferably constructed to be relatively thin, can thus be more easily brought to the desired nominal temperature.

The thermal conductivity can be determined in a defined manner by the structure of the roller area adjacent to the outside roller surface. Here, it is possible to provide layers of selected metals or metal alloys.

Preferably, sensor devices are provided, by which means the temperature of the roller surface can be monitored and, on the basis of the corresponding measurement values, regulated. In addition to the non-contacting detecting sensors, contact sensors also may be used. The latter are relatively robust and available at low cost. Preferably, the temperature of the smoothing roller is detected at several sites. In order to take into account the heat transfer, which is increased, particularly in the side area of the roller carrying the printed sheet or the printing material, it is possible to match the temperature distribution of the smoothing roller to a prespecified temperature profile. Preferably, temperatures are thereby selected in the vicinity of the shaft ends of the smoothing roller, which are approximately 5 to 10 K above the temperature in the middle area.

Temperature regulation preferably is to adjustable for local variations in heat dissipation. This is particularly advantageous when using a heating radiator arrangement.

The measurement signals produced by the monitoring of the surface temperature of the rollers also can be processed by a safety circuit. Thus, it is possible to permit access to the smoothing rollers only when they are cooled to an admissible contact temperature.

The roller arrangement in accordance with the invention can be placed upstream to a printing unit. In this way, it is possible to attain a uniform spreading on the paper in a manner that can be favorably implemented with respect to plant technology. Alternatively, or in combination with this measure, it is possible to provide the proposed roller arrangement downstream from the printing unit, for example, to apply a lacquer.

In accordance with a particularly preferred embodiment of the invention, a transfer module that can be provided, for example, downstream from a lacquering unit. In this transfer module, several rollers with defined surface characteristics can run against the printed sheet and thereby heat the printed sheet surface and correspondingly compress it to increase the] contact pressure, adjusted in the individual roller nip.

Following this transfer module, the sheet can be placed on a placement drum, or for the purpose of smoothing a paper coating, it can be passed on to a successive printing unit. A cooling of the sheet can be carried out by contact with a cooled roller, or preferably several cooled rollers and preferably in the area where the paper exits. Also in the area where the paper ascends, it is possible to implement a cooling roller placement, directly in conjunction with the cylinder carrying the sheet. Cooling by cold air or ambient air, and in particular, by means of air vanes and ventilators can be implemented.

Especially for smoothing of paper coating, it is advantageous to place at least one, and preferably, at least two, smoothing rollers where the sheet of a successive printer ascends. As long as there is still no ink on the sheet, or the ink application has already solidified, comparatively high roller temperatures can be used. In this way, it is possible to coat the sheet smoothly, at least with regard to the paper coating, within the framework of contact with the heated roller.

With selected layering or coating materials and printing inks, it also is possible to provide a heated smoothing roller in the area where the sheet exits. However, the roller contact pressure and preferably also the roller temperature are preferably set at lower values. Immediately afterwards, the sheet can then be conducted through a cooling roller nip, wherein the surface characteristics of the cooling roller takes into account the required degree of sheet smoothing.

It also is possible to modify an existing double lacquering unit to a roller arrangement in accordance with the invention. In this regard, for example, a plate can be inserted which has a defined surface roughness and an intermediate layer of an insulating layer, for example, plastic material. Furthermore, a heat source, preferably a heat radiator, is used in such a way on the modified cylinder of the double lacquering unit that a defined heating of the exterior plate surface is made possible. A suitable location in this regard is in the area of a chamber doctor, e.g., otherwise placed here with a lacquering unit. Suitable plates may include, specifically, copper or steel plates, e.g., which are very finely polished. Alternatively, it also possible to insert a composite plate on the corresponding cylinder (for example, a lacquering form cylinder), wherein this composite plate can be heated using strip heaters or heating plates. For example, the heating plate can be made of electrically conductive plastic. Voltage can be supplied by rotating transferring units, for example, in the form of slip-ring arrangements, with a comparatively low-technical device outlay. The furnishing of a double lacquering cylinder proves to be particularly advantageous, especially with respect to the high bending strength of this cylinder and with respect to its high inherent weight.

A particularly effective smoothing or also embossing of the printed sheet can be attained in accordance with one particular aspect of the invention in that in a proposed lacquering unit, for example, in the first lacquering unit, a heat-meltable lacquer is applied on the sheet and the surface of the sheet prepared in this manner is smoothed in a transfer module equipped with the heating roller arrangement in accordance with the invention. The heating temperature in the transfer module and the rate of movement of the printed sheet preferably are adjusted in such a way that the heating of the printed sheet has not yet completely subsided before its entry into a subsequent lacquering unit. In this way, it is possible to continue to treat the surface of the printed sheet in the second lacquering unit, for example, by a lacquer plate inserted in the corresponding cylinder. This lacquer plate can have a defined surface structure, perhaps with a glossy-matte finish. By using a trimetal plate etched in a defined manner, it is possible to combine different matte/gloss effects in one job. Embossing effects, for example, for the creation of desired lacquer embossing, can be attained by corresponding surface structures in the roller.

With regard to a method for the surface treatment of a substrate, especially a printed sheet, the invention is carried out in the framework of a substrate transport step, the substrate, particularly, a printed sheet, being conveyed into a roller nip by placement on a first roller surface formed by a first roller, and there is pressed by the roller surface of a second roller against the first roller surface, and the roller surface of the second roller is heated to a prespecified temperature of at least 350 K. The roller surface of the second roller is preferably heated to a temperature in the range of 390 K to 420 K. Preferably, the contact force of the second roller against the first roller is set to a value in the range of 10 to 25 N/cm, in accordance with the roller length.

The required smoothing effect is preferably achieved with the roller surface of the second roller being formed by a metal body and having a defined surface roughness, matched to the smoothing effect. It is possible to construct debrisrepelling structures, so-called lotus leaf structures, on the substrate by corresponding complementary surface configurations of the smoothing roller.

In particular, with a comparatively high heating of the printed sheet and the further conducting of the printed sheet to a successive printing unit, provision is made in accordance with a preferred method variant to convey the printed sheet to a second roller nip by means of the first roller, wherein the second roller nip is formed in conjunction with another roller, whose outside surface is cooled to a predetermined temperature, preferably in the range of 280 K to 300 K.

The apparatus in accordance with the invention also is characterized by a roller device for a sheet-fed offset printer, which has a first roller that is largely resistant to bending and carries a printed sheet and has at least one roller that is heated while rolling on the sheet, whose surface is matched to the required printed sheet smoothing. Preferably, several rollers of defined surface roughness are arranged axially parallel to one another, following in the circumferential direction of the first roller. The first roller can form part of a transfer module or printer.

Other objects and advantages of the invention will become apparent upon reading the following detailed description and upon reference to the drawings, in which:

Figure 1:
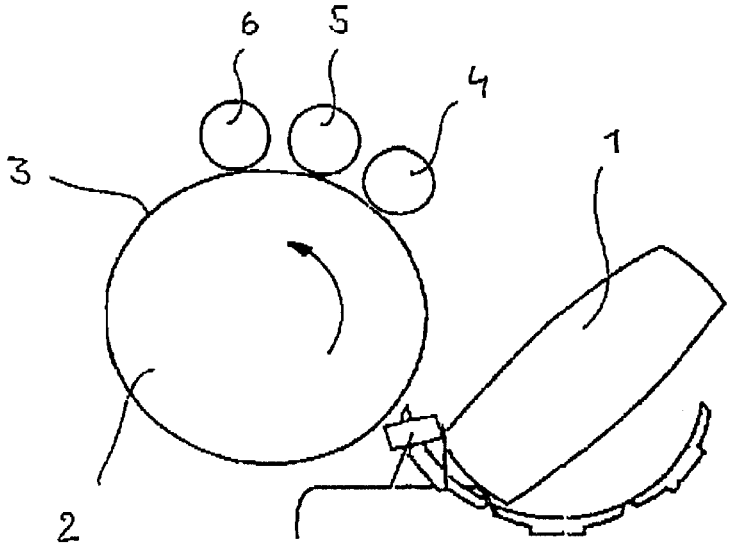
FIG. 1 is a partially diagrammatic depiction of a printing machine transfer module invention having a plurality of smoothing rollers at least one of which can be heated to a predetermined temperature.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENT

Referring now more particularly to FIG. 1 of the drawings, there is shown an illustrative transfer module for a sheet-fed printing machine in accordance with the invention, which includes a transfer drum 1 and a transfer cylinder 2. The transfer cylinder 2 has appropriate sheet grippers of a known type, not depicted in the drawing, for releasably engaging the front edges of printed sheets for movement about the transfer cylinder 2 in the direction of sheet travel. The transfer cylinder 2 in this case forms a circumferential placement surface 3 for at least one printed sheet. This placement surface preferably has a surface roughness formed by an appropriate machining process. About the outside circumference of the transfer cylinder 2, three smoothing rollers 4, 5, 6 are provided in succession. These smoothing rollers 4, 5, 6 which are smaller in diameter than the transfer cylinder 2, have a comparatively high bending resistance and are mounted for pressing contact against the outside surface of the transfer cylinder 2 with adjustable radial forces.

In accordance with the invention, the smoothing rollers are rotatable in a direction opposite the transfer roller, and at least some of the smoothing rollers are provided with a heating device or devices for heating the outside circumferential surfaces of the smoothing rollers 4, 5 to a desired temperature level. In this case, the smoothing rollers 4, 5 have respective associated heating devices, such as will be described below in more detail. Smoothing roller 6 in this instance acts together with a cooling device, wherein the outside circumference of this roller preferably can be cooled to a temperature of about 25 C. The smoothing rollers 4, 5, 6 have a surface roughness which corresponds with the desired smoothing effect on the surfaces of sheets being directed about the transfer roller 2. Preferably, the surface of the smoothing roller 6, namely the last of the three smoothing rollers in the direction of sheet transfer, is slightly smoother than the preceding rollers 4, 5.

Figure 2:
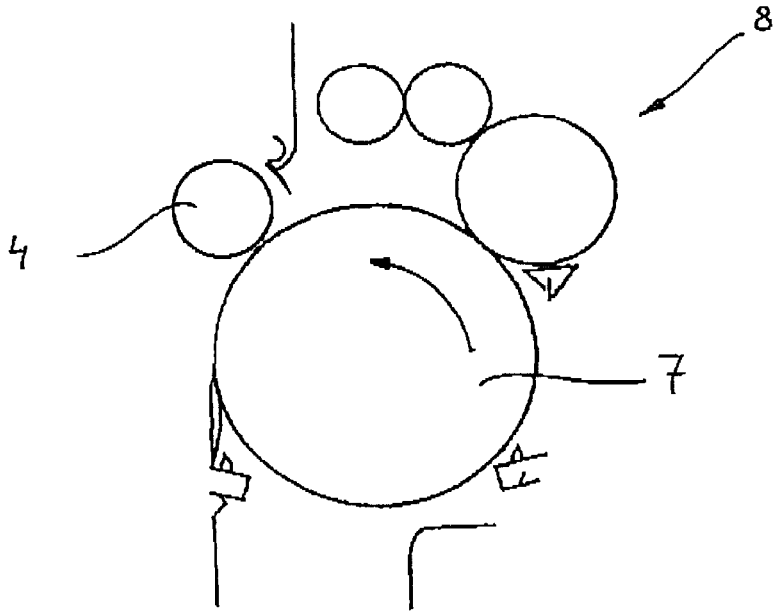
FIG. 2 is a diagrammatic depiction of a second embodiment of transfer module in accordance with the invention having a smoothing roller arranged at the exit location of a lacquering/spreading module.

Referring to FIG. 2, there is shown an alternative embodiment of sheet transfer module which is integrated as a unit into an area where printed sheets exit a lacquering or spreading module. This embodiment includes a printing cylinder 7 having a lacquering or spreading module 8 and a heated smoothing roller 4 downstream of the lacquering and spreading module 8. The heated smoothing roller 4 contacts successive printed sheets which can be provided substantially about the entire outside circumferential surface of the printing cylinder 7. In conjunction with the heated smoothing roller 4, the lacquering or spreading device 8 is effective for providing to printed sheets with a surface smoothed according to the surface characteristics of the smoothing roller 4.

Figure 3:
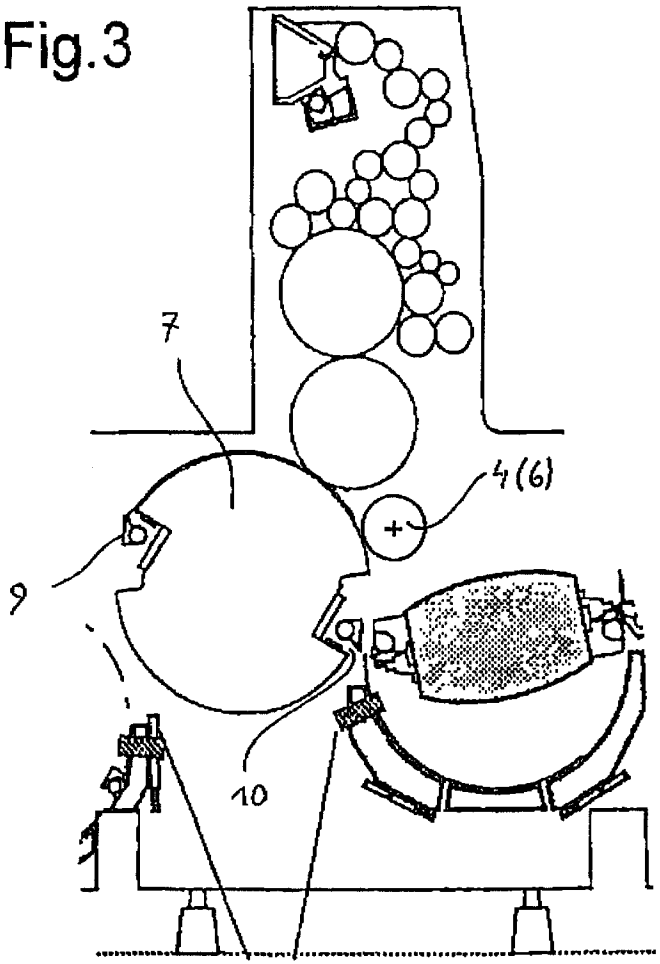
FIG. 3 is a diagrammatic depiction of a third embodiment of a transfer module in accordance with the invention having a smoothing roller disposed in the area where sheets ascend after a spreading unit.

With reference to FIG. 3, a further alternative embodiment of transfer module is disclosed which has a roller arrangement including a smoothing roller 4, 6 in conjunction with a printing cylinder 7. The smoothing roller 4 in this case is located in the area where sheet ascend after leaving a spreading unit (not shown). In this embodiment, the printing cylinder 7 has two sheet grippers 9, 10. Vibration of the smoothing roller 4, 5 can be avoided by a rigid support for the smoothing roller 4, 5 and lateral supports for the grippers.

Figure 4:
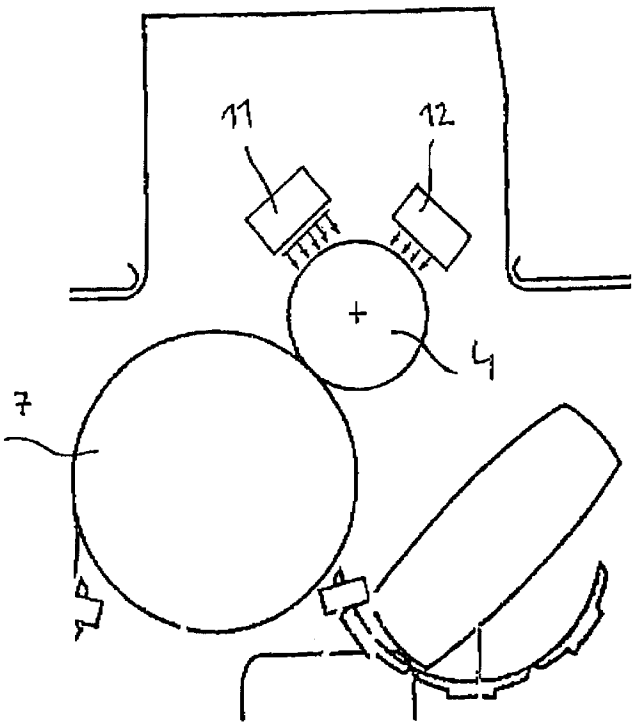
FIG. 4 is a diagrammatic depiction of a further alternative embodiment of a transfer module according to the invention.

Referring now to FIG. 4, a further alternative embodiment of transfer module is shown which includes a printing cylinder 7 and a smoothing roller 4 having radiant heat devices 11, 12 disposed about the periphery of the smoothing roller 4. The smoothing roller 4 in this case is a form cylinder on which a plate with a defined surface roughness is inserted or otherwise mounted. The exterior surface of the form cylinder is matched to the exterior circumference of the printing cylinder with a determined integer circumference/length ratio.

In carrying out this embodiment of the invention, the radiant heating devices 11, 12 are designed to direct radiant heat onto the smoothing surface 4 in the infrared range. The radiation density distribution is selected in such way that in the event a temporary interruption in rotation of the smoothing roller, no excessive local temperatures are reached.

Figure 5:
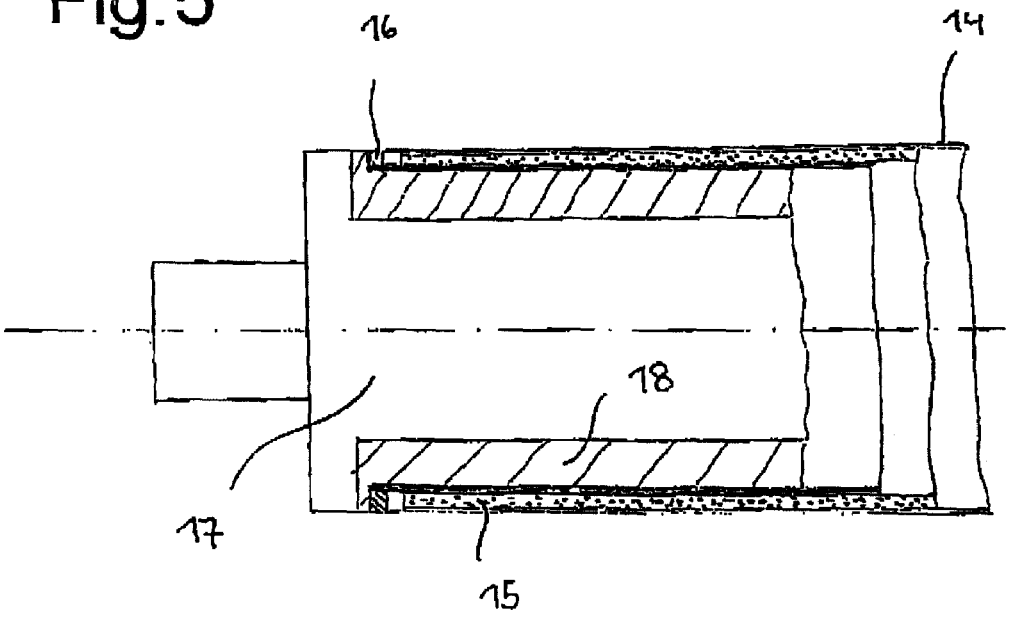
FIG. 5 is an axial section of one embodiment of roller having an integrated heating device that can be used in certain of the illustrated transfer modules.
Figure 6:
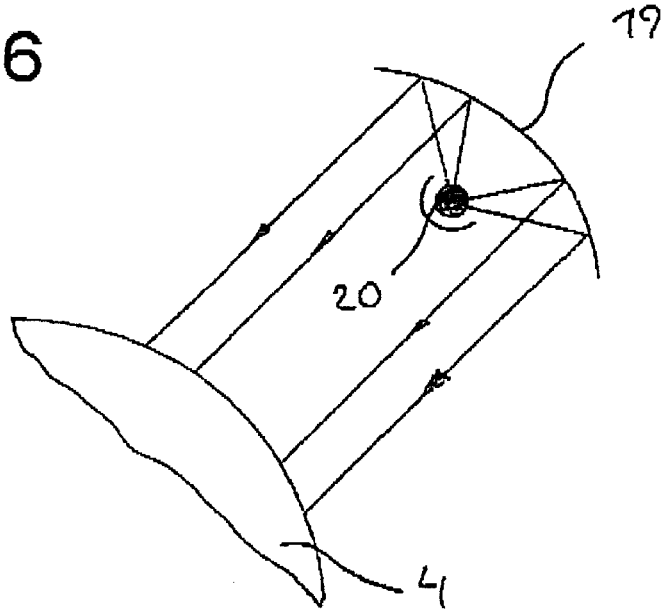
FIG. 6 is a diagrammatic depiction of an alternative roller embodiment having a radiant heat source.

As depicted in FIG. 5, the heated smoothing roller 4, 5 alternatively may be heated from the interior. The smoothing roller 4 in this case comprises a plate 14 which defines the outer surface of the roller and is made, for example, from a polished steel plate. The plate 14 sets on a plastic layer 15 made of electrically conductive plastic. Voltage is provided via a pair of slip-ring devices 16, only one side of which is shown, which is connected in conductive fashion with the plastic layer 15. An insulating layer 18 is provided between the heating device formed by the plastic layer 15 and a roller core 17 for reducing heat transfer into the core 17.

Still another alternative heating device for the smoothing roller 4, 5 is shown in FIG. 16. In this instance, heat is radiated onto the outside surface of the smoothing roller 2 via a reflector arrangement 19. An infrared lamp 20 is provided as the radiation source, and a shielding device 21 is located between the infrared lamp 20 and the smoothing roller 4 for preventing direct radiation onto the smoothing roller.

It will be understood by one skilled in the art that the invention is not limited to the embodiments and examples described above. For example, it is also possible to use the roller arrangement in accordance with the invention for the surface treatment in roller or web printing processes. Improved surface characteristics are attained by the formation of the proposed roller arrangement where the sheet ascends, even without temperature-controlling the smoothing roller.

It will be understood by one skilled in the art that the invention is not limited to the embodiments and examples described above. For example, it is also possible to use the roller arrangement in accordance with the invention for the surface treatment in roller or web printing processes. Improved surface characteristics are attained by the formation of the proposed roller arrangement where the sheet ascends, even without temperature-controlling the smoothing roller.

What is claimed is:

1. In an offset printing machine having at least one printing unit in which a printing substance is applied to sheets and the printed sheets are directed through the printing machine comprising an apparatus for treating surfaces of the printed sheets, said surface treating apparatus including a first roller (2,7) rotatable in a first direction and having a placement surface for sheets during travel through said machine, a second roller, (4, 5, 6) mounted in axially parallel relation to said first roller (2,7) for defining a roller nip with said first roller (2,7) through which printed sheets are directed, said second roller (4, 5, 6) being mounted with a preset radial force in the range of 10–25 N/cm against said first roller (2,7) at said nip, said second roller (4, 5, 6) having a diameter smaller than the diameter of said first roller (2, 7) and being rotatable in a direction opposite to the direction of rotation of said first roller (2, 7), and a heating device (11, 12, 15, 16) operatively associated with said second roller (4, 5, 6) for heating the surface of the second roller in the region of the roller nip between said first roller (2, 7) and the second roller (4, 5, 6) to a temperature of at least about 350° K as the sheet passes through the nip whereby the heat and pressure on the printed sheet smoothes the surface of the printing substance on the printed sheet passing through the nip.

2. The apparatus of claim 1 which said heating device (11, 12) is arranged for heating the outside surface of the second roller (4, 5, 6) from outside of the roller.

3. The apparatus of claim 2 in which said heating device (11, 12) includes a radiant heat source.

4. The apparatus according to claim 2 in which said heating device is integrated in said second roller.

5. The apparatus of claim 2 in which said roller (4, 5,6) has an exterior surface with a predetermined surface roughness.

6. The apparatus of claim 2 including at least one roller (5, 6) mounted in axially parallel relation to said second roller (4), said second and said other roller being disposed in circumferentially spaced relation about the first roller (2, 7), and said second and other roller each being operatively for exerting a radial forces on sheets on the placement surface of the first roller, (2, 7).

7. The apparatus of claim 2 in which said second roller (4, 5, 6) is mounted for pressing printed sheets against the first roller with selectively adjustable radial forces.

8. The apparatus of claim 2 in which said heating device is operable for adjustably heating the outside surface of the second roller to a desired temperature.

9. The apparatus of claim 2 including at least one other roller (6) mounted in axially parallel relation to said second roller (4), said second and said other roller being disposed in circumferentially spaced relation about the first roller (2, 7), and said other roller is cooled to a temperature less than the temperature of the surface of said second roller.

10. The apparatus of claim 2 in which said first roller (7) is a lacquering module roller of a lacquering unit, and said second roller is located in an area where printed sheets exit said lacquering unit.

11. The apparatus of claim 2 in which said first roller (2) is a transfer module roller.

12. The apparatus of claim 2 in which said second roller is located in an area where printed sheets move in ascending relation to said first and second rollers.

13. The apparatus of claim 1 in which said heating device heats the printed sheets in the region of the nip by directing heat to the second roller.

14. The apparatus of claim 1 in which said heating device heats the printed sheets in the region of the nip by directing heat through the second roller.

15. A method for surface treatment of printed sheets in a sheet fed printing machine comprising the steps of printing a printed substance on the sheets by passing the sheets through at least one printing unit, subsequently conveying the printed sheets to a roller nip defined by a roller surface of a first roller and a roller surface of a second roller, pressing the sheets against the first roller surface by means of the second roller surface with a force in the range of 10–25 N/cm, and heating the roller surface of the second roller in the region of the nip to a predetermined temperature of at least about 350K during the pressing step for heating the printed sheets at the location of said nip between said first and second rollers as they are directed through the nip to smooth the surface of the printed substance on the sheets.

16. The method of claim 15 including heating the roller surface of said second roller to a temperature in the range of 390K to 420K.

17. The method of claim 15 including forming said roller nip by the roller surface of said first roller and by the roller surface of the second roller which is defined by a metal body having a predetermined surface hardness.

18. The method of claim 15 including conveying the printed sheets to a second roller nip after said first roller nip defined by the roller surface of said first roller and the roller surface of another roller, and cooling the exterior surface of said another roller to a temperature less than the temperature of the surface of said second roller.

* * * * *